US007370440B1

(12) United States Patent
Cole, III

(10) Patent No.: US 7,370,440 B1
(45) Date of Patent: May 13, 2008

(54) FOOTWEAR CINCH

(76) Inventor: Charles D. Cole, III, 405 W. Palm Ave., Redlands, CA (US) 92373

( * ) Notice: Subject to any disclaimer, the term of this patent is extended or adjusted under 35 U.S.C. 154(b) by 573 days.

(21) Appl. No.: 10/913,985

(22) Filed: Aug. 6, 2004

Related U.S. Application Data

(60) Provisional application No. 60/493,491, filed on Aug. 8, 2003.

(51) Int. Cl.
*A43C 11/00* (2006.01)

(52) U.S. Cl. ..... 36/50.1; 36/88; 36/93

(58) Field of Classification Search ..... 36/50.1, 36/50.5, 51, 88, 93
See application file for complete search history.

(56) References Cited

U.S. PATENT DOCUMENTS 1,683,465 A * 9/1928 Hill ..... 36/50.1
2,143,556 A * 1/1939 Hodaly ..... 36/45
3,703,775 A * 11/1972 Gatti ..... 36/128
6,052,921 A * 4/2000 Oreck ..... 36/50.1
6,088,936 A * 7/2000 Bahl ..... 36/50.1
6,128,835 A * 10/2000 Ritter et al. ..... 36/45
6,505,424 B2 * 1/2003 Oorei et al. ..... 36/129

* cited by examiner

*Primary Examiner*—Jila M Mohandesi
(74) *Attorney, Agent, or Firm*—Khorsandi Patent Law Group, A Law Corporation; Marilyn R. Khorsandi

(57) ABSTRACT

In the exemplary embodiment of the present invention, an instep strap would be used to increase tension on a cord that would substantially encircle a circumference of an ankle portion of a shoe. In the exemplary embodiment, a first end of the cord would be attached to an instep portion of a first side of a shoe upper; a second end of the cord would be attached to an instep portion of a second side of the shoe; and the cord would pass through at least one channel substantially disposed around the circumference of the ankle portion of the shoe. In an alternative exemplary two-cord embodiment of the present invention, an instep strap would be used to increase tension on two cords. By tightening and fastening the instep strap, both cords would be somewhat distorted and a tension would be created, or increased, thereby causing a snug fit of the shoe.

13 Claims, 9 Drawing Sheets

FOOTWEAR CINCH

CROSS-REFERENCE TO RELATED APPLICATIONS

Priority is claimed to U.S. Provisional Patent Application Ser. No. 60/493,491, entitled "FOOTWEAR ANKLE CINCH", filed on Aug. 8, 2003, the disclosure of which is incorporated for all purposes herein in full by reference as if stated in full herein.

FIELD OF THE INVENTION

The field of the present invention is shoes, and specifically shoes for sports.

BACKGROUND OF THE INVENTION

In order to climb or maneuver rock or other formations, climbers, mountaineers and other sports enthusiasts sometimes engage the back of the heel of one of their shoes with a rock, ledge or other surface in order to climb. This maneuver is sometimes referred to in sports as "heeling." FIG. 1 depicts a close-up view of the back of the heel 2 of a climber's 3 shoe 1 engaging a rock surface 4 in a heeling maneuver. The heeling maneuver creates a force against the back of the heel 2 that tends to urge the shoe 1 off of the climber's 3 foot. Partial dislodging, or complete removal, of the shoe can substantially endanger the climber's safety. Some way is needed to better secure a shoe to a climber's foot to minimize dislodgement of the climber's shoe(s) as a result of heeling maneuvers.

When walking, a walker may experience what is sometimes referred to in the shoe industry as "heel lift." Heel lift is the slight slipping of the heel of a shoe away from the foot of the wearer. When walking, as the wearer's foot pivots from the heel of the foot to the ball of the foot, the wearer's shoe may slightly slip down on the heel of the wearer. When the wearer's heel next contacts the surface on which the wearer is walking, the heel of the shoe is urged back onto the foot. Heel lift causes blisters. Heel lift is often more prominent in stiff-soled shoes, such as hiking and climbing shoes. Some way is needed to better secure a shoe to a walker's foot to minimize heel lift.

SUMMARY OF THE INVENTION

In the exemplary embodiment of the present invention, an instep strap would be used to increase tension on a cord that would substantially encircle a circumference of an ankle portion of a shoe. In the exemplary embodiment, a first end of the cord would be attached to an instep portion of a first side of a shoe upper; a second end of the cord would be attached to an instep portion of a second side of the shoe; and the cord would pass through at least one channel substantially disposed around the circumference of the ankle portion of the shoe.

The exemplary embodiment of the present invention would comprise a shoe with an exemplary ankle cinch. The exemplary shoe would comprise a plurality of channels disposed around a circumference of an ankle portion of the shoe; and a cord, attached at a first end to a first side of an instep of the shoe, said cord would be disposed through the plurality of channels, and said cord would be attached at a second end to an instep strap.

The exemplary shoe would comprise a shoe upper. The exemplary shoe upper would comprise an ankle portion and an instep. The instep of the exemplary shoe upper would comprise a first side that is opposite a second side. The exemplary shoe would further comprise at least one instep strap. The exemplary instep strap would comprise a first end and a second end, wherein said first end would be connected to the first side of the instep. The exemplary shoe would further comprise a plurality of channels disposed around the circumference of the ankle portion of the shoe upper. In the exemplary embodiment, a cord comprising a first end, a second end, and a body, would be connected at its first end to the second side of the instep. The second end of the exemplary cord would be connected to the instep strap. The body of the cord would be disposed through said channels so that the cord substantially extends around the circumference of the ankle portion of the shoe upper. In the exemplary embodiment, the instep strap would pass under the cord on the second side of the instep. In the exemplary embodiment, a pulley would be disposed on the cord and the instep strap would pass under, and then over, the pulley.

The exemplary embodiment of the present invention would provide an exemplary method of snugly cinching a shoe. The exemplary method would comprise attaching a first end of a cord to a first side of an instep of a shoe; stringing a second end of the cord through a plurality of channels disposed around the circumference of the ankle portion of the shoe; and attaching the second end of the cord to an instep strap, wherein a first end of the instep strap is attached to a second side of the instep of the shoe. In the exemplary method, a second end of the instep strap would be threaded, first under, and then over, the cord. In the exemplary method, the second side of the instep would be opposite the first side of the instep.

In an alternative exemplary two-cord embodiment of the present invention, an instep strap would be used to increase tension on two cords: a first end of a first cord would be attached to an instep portion of a first side of a shoe upper; a second end of the first cord would be attached to a heel portion of the first side of the shoe; a first end of a second cord would be attached to an instep portion of a second side of the shoe upper; a second end of the second cord would be attached to a heel portion of the second side of the shoe; the first cord would pass through at least a first channel disposed around the circumference of the ankle portion of the shoe; the second cord would pass through at least a second channel disposed around the circumference of the ankle portion of the shoe; the instep strap would be attached to one of the cords, for example, the second cord, and would pass under, and then over, the other of the cords, for example, the first cord. By tightening and fastening the instep strap, both cords would be somewhat distorted and a tension would be created, or increased, thereby causing a snug fit of the shoe.

In the alternative exemplary two-cord embodiment of the present invention, a method of snugly cinching a shoe would be provided that would comprise: attaching a first end of a first cord to a first instep portion of a first side of a shoe upper of the shoe; threading a second end of the first cord through at least one channel, wherein said at least one channel is disposed around a circumference of the ankle portion of the shoe; attaching the second end of the first cord to a heel portion of the first side of the shoe upper of the shoe; attaching a first end of a second cord to an instep portion of a second side of a shoe upper of the shoe; attaching a second end of the second cord to a heel portion of the second side of the shoe upper of the shoe; and enclosing a portion of the second cord with a first end of a strap, wherein a second end of the strap is adapted for threading under a portion of the first cord.

In the alternative exemplary two-cord embodiment of the present invention, the shoe would comprise: at least one channel disposed around a circumference of an ankle portion of the shoe, wherein the channel is adapted for receiving a cord inserted therethrough; a first cord, said first cord comprising a first end and a second end, wherein said first end of said first cord is attached to an instep portion of a first side of a shoe upper of the shoe, and wherein the second end of the first cord is attached to a heel portion of the first side of the shoe upper of the shoe; a second cord, said second cord comprising a first end and a second end, wherein said first end of said second cord is attached to an instep portion of a second side of a shoe upper of the shoe, and wherein the second end of the second cord is attached to a heel portion of the second side of the shoe upper of the shoe; and an instep strap, said strap comprising a first end and a second end, wherein the first end of the strap is disposed to form a loop, said loop disposed to receive a portion of the second cord, and wherein the second end of the strap is adapted for threading under a portion of the first cord.

BRIEF DESCRIPTION OF THE DRAWINGS

These and other features of the present invention are more fully set forth in the following description of exemplary embodiments of the invention. The description is presented with reference to the accompanying drawings in which.

DETAILED DESCRIPTION OF THE INVENTION

Figure 1:
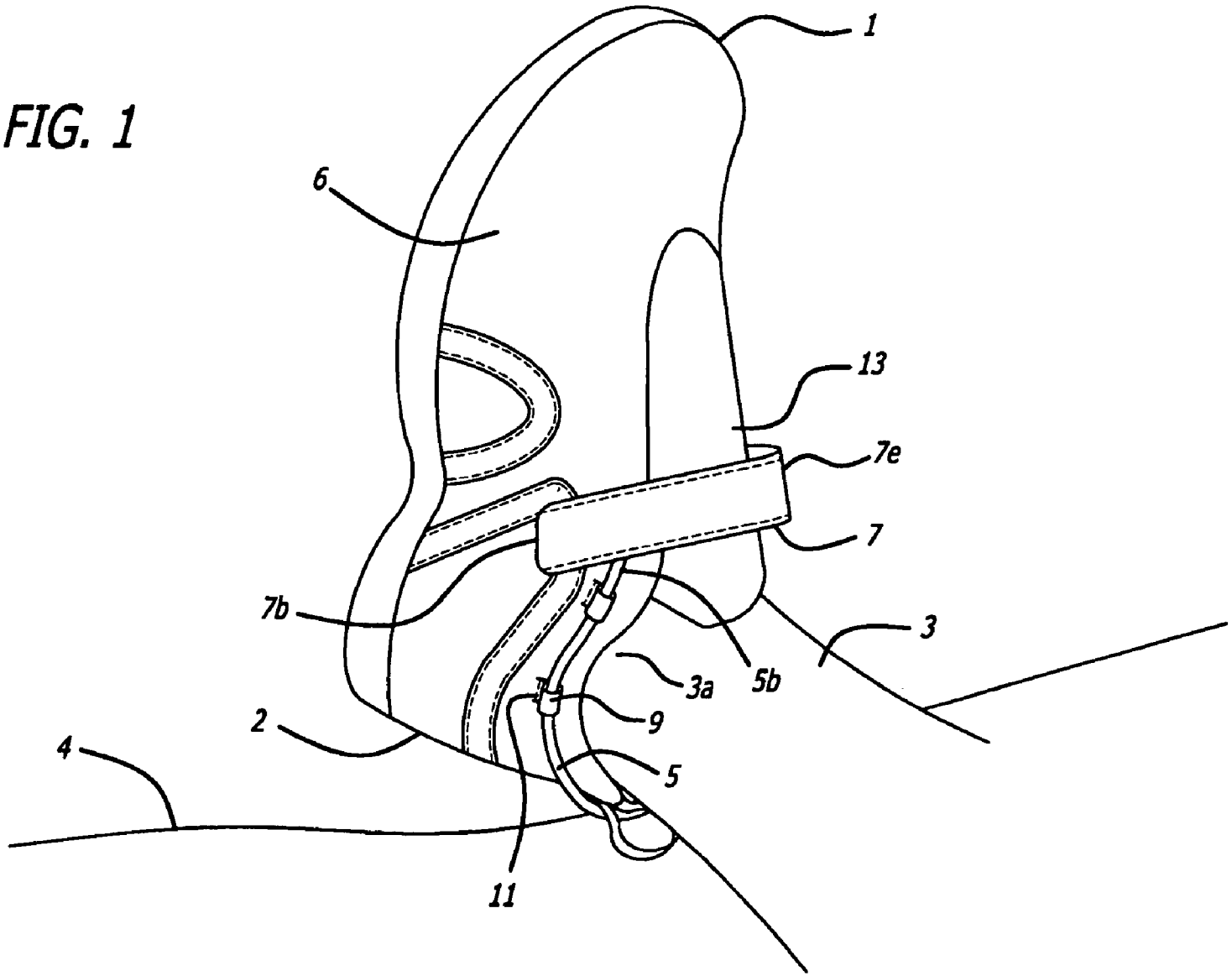
FIG. 1 depicts a side perspective view of an exemplary shoe with an exemplary ankle cinch in an exemplary embodiment of the present invention.
Figure 2:
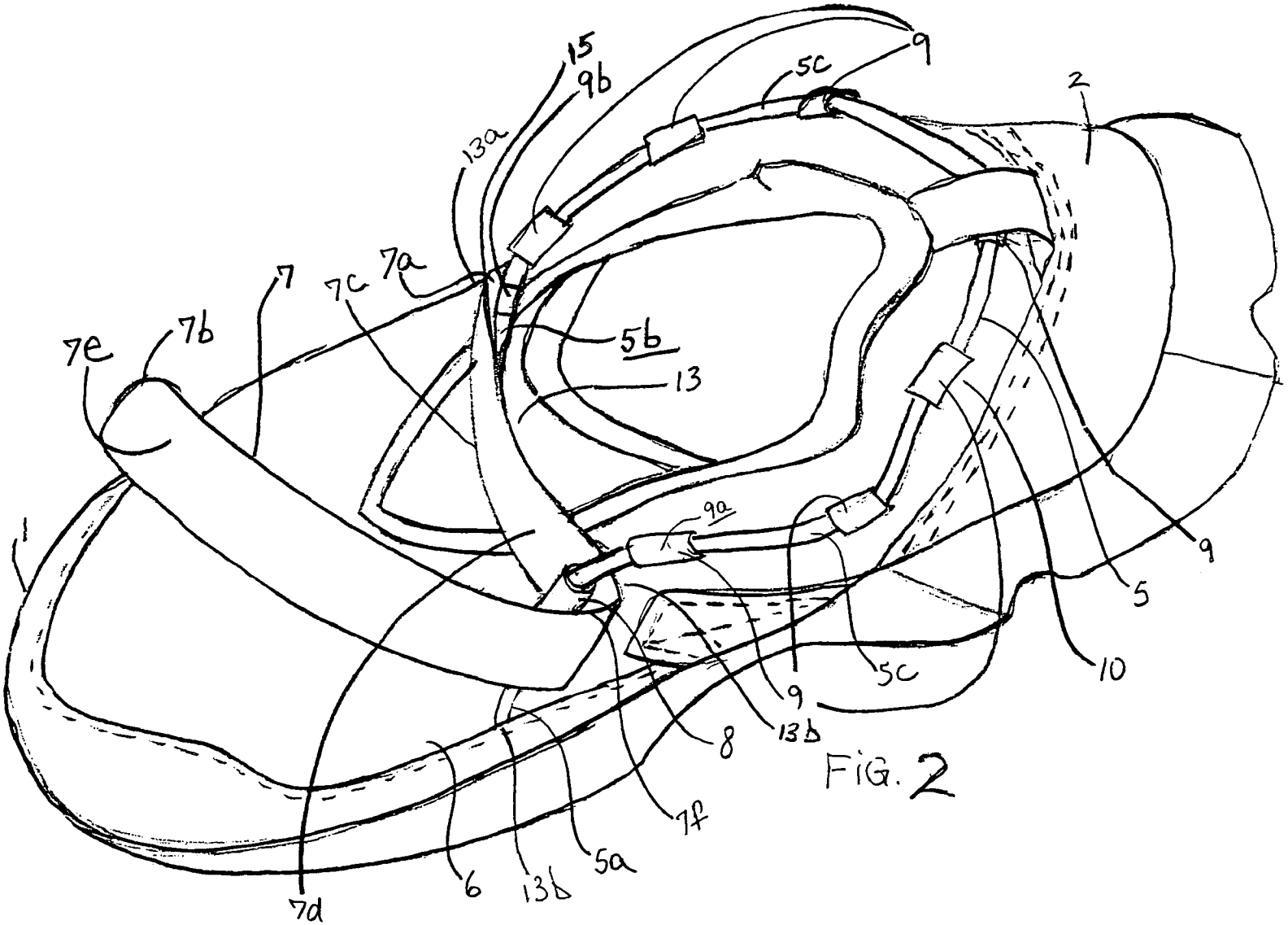
FIG. 2 depicts a top perspective view of an exemplary shoe with an exemplary ankle cinch in an exemplary embodiment of the present invention.

FIGS. 1 and 2 depict an exemplary shoe with an exemplary ankle cinch in an exemplary embodiment of the present invention.

With reference to FIGS. 1 and 2, the exemplary ankle cinch would comprise a cord 5 that would comprise a first end 5*a*, a second end 5*b*, and a body 5*c* between the first and second ends 5*a* and 5*b*, respectively. The first end 5*a* of the cord would be attached to a side 13*b* of the shoe upper 6, such as by stitching. The second end 5*b* of the cord would be attached to an instep strap 7. In the exemplary ankle cinch, the body 5*c* of the cord 5 would pass through at least one pulley 8 and a plurality of channels, or loops 9. In the exemplary embodiment, the cord 5 would be comprised of shoelace material, such as nylon cording.

Figure 3:
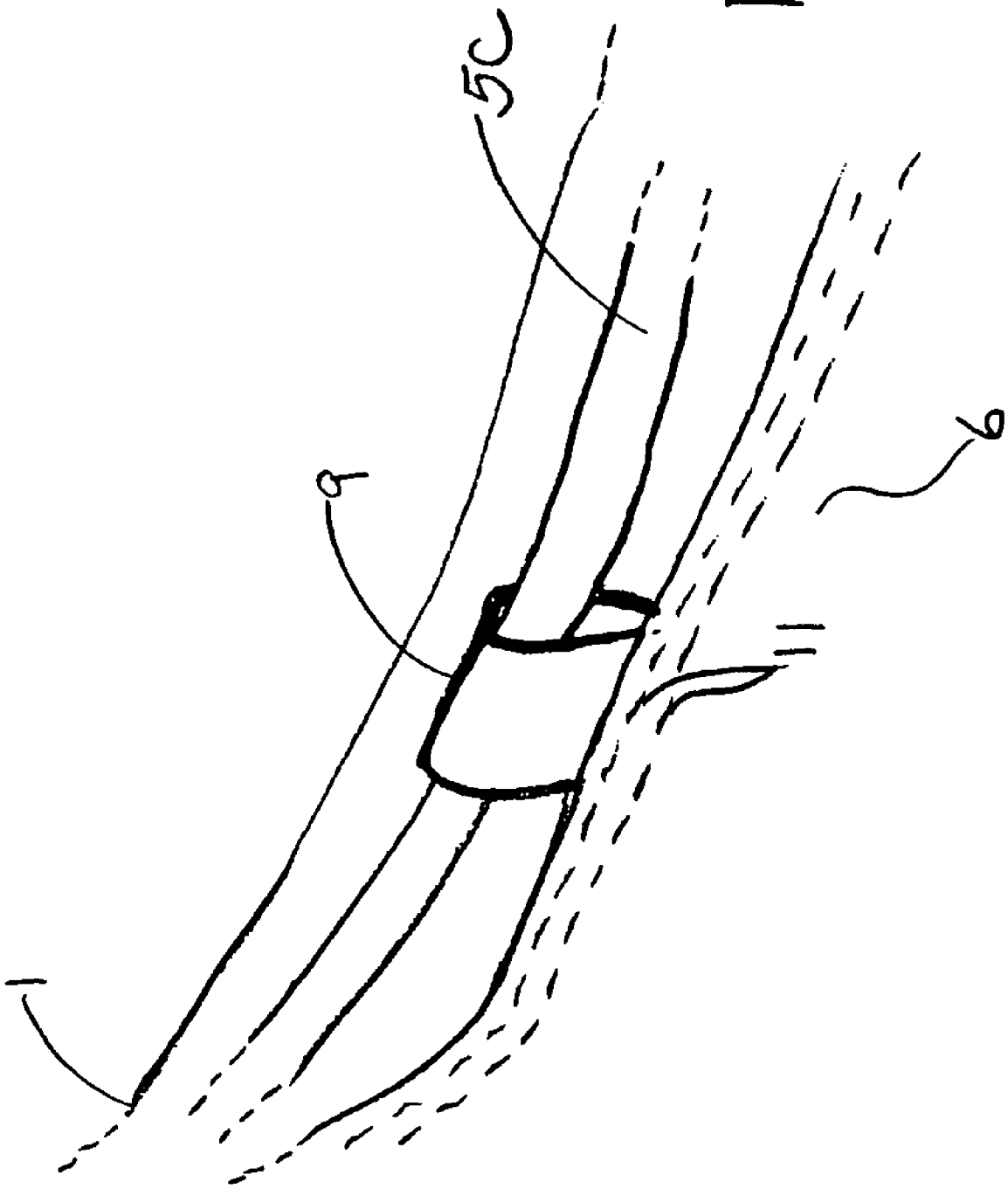
FIG. 3 depicts an enlarged view of a channel and a portion of the body of a cord inserted therethrough.

In the exemplary embodiment, the channels, or loops, 9 would be attached (such as by stitching), or would be integral (see FIG. 6), to an ankle-level portion 10 of the shoe upper 6. FIG. 3 depicts an enlarged view of a channel 9 and a portion of the body 5*c* of the cord 5 inserted therethrough. Stitching 11 would fasten channel 9 to the shoe upper 6.

Figure 4:
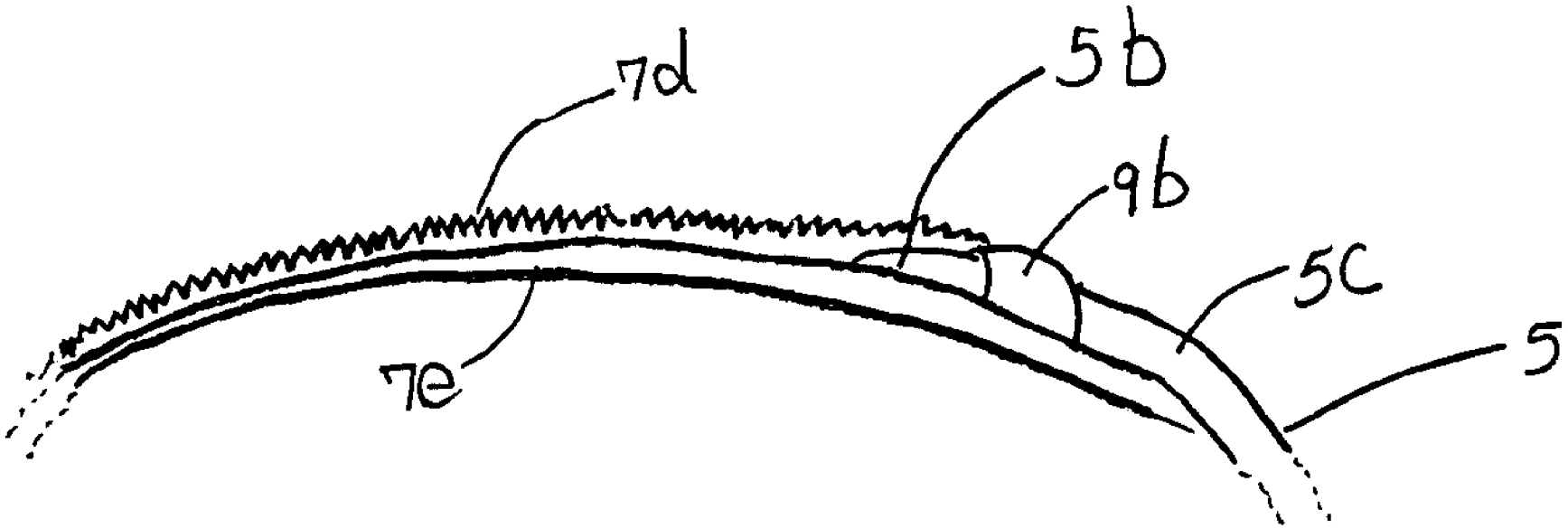
FIG. 4 depicts an enlarged side perspective view of a portion of an exemplary instep strap.

In the exemplary ankle cinch, the instep strap 7 would comprise a first end 7*a*, a second end 7*b*, and a body 7*c*. The first end 7*a* of the instep strap 7 would be attached to the shoe upper 6, such as by stitching, on one side, e.g., 13*a*, of the instep 13 of the shoe upper 6. FIG. 4 depicts an enlarged side perspective view of a portion of the exemplary instep strap 7.

With reference to FIGS. 2 and 4, the exemplary instep strap 7 would comprise an outer layer 7*e*. In the exemplary embodiment, the outer layer 7*e* would be a leather, or synthetic leather, material. The exemplary instep strap 7 would further comprise an inner layer 7*d*. In the exemplary embodiment, the inner layer 7*d* would comprise a hook and loop material, such as, for example, VELCRO®.

The inner layer 7*d* of the second end 7*b* of the instep strap 7 would be adapted to be attached with the hook and loop properties of the hook and loop material to the inner layer 7*d* of the first end 7*a* of the instep strap 7.

With reference to FIG. 4, the second end 5*b* of the cord 5 would be inserted and attached between the inner layer 7*d* and the outer layer 7*e* of the instep strap 7. With reference to FIG. 2, the second end 5*b* of the cord 5 would be attached to an instep strap 7 at an area 15 that would be between the second end 5*b* and a midsection 7*f* of the instep strap 7. Returning with reference to FIG. 4, in the exemplary embodiment, a channel 9*b* would be attached between the inner layer 7*d* and the outer layer 7*e* of the instep strap 7. The body 5*c* of the cord 5 would be inserted through the channel 9*b* for support, stabilization and strengthening of the attachment of the second end 5*b* of the cord 5 to the instep strap 7.

Returning with reference to FIGS. 1 and 2, the pulley 8 in the exemplary embodiment would comprise a metallic tube. The cord 5 would extend through the pulley 8. In the exemplary embodiment, the diameter of the cord 5 would be slightly smaller than the diameter of the interior tube of the pulley 8 so that the pulley 8 would be adapted for rotation about the cord 5. The pulley 8 in the exemplary embodiment would have a length that is slightly greater than the width of the instep strap 7. A first channel 9*a* would be attached to the shoe upper 6 on one side of the pulley 8. A second channel (not shown) could be attached to the shoe upper on the other side of the pulley 8. Alternatively, as depicted in FIG. 2, the first end 5*a* of the cord 5 would be attached to the shoe upper.

Lateral movement of the pulley 8 along the length of the cord 5 would be bounded on one side by the channel 9*a*, and on the other side by the attachment of the first end 5*a* of the cord 5 to the shoe upper 6, or alternatively by the second channel (not shown) attached to the shoe upper on the other side of the pulley 8. The restriction of lateral movement of the pulley 8 along the length of the cord 5 by the placement of the two channels on either side of the pulley 8, or alternatively, by the channel 9*a* and the attachment to the shoe upper, would urge the pulley 8 to be seated over the midsection 7*f* of the body 7*c* of the instep strap 7.

It will be understood by someone with ordinary skill in the art that benefits of the present invention could be enjoyed without the use of a pulley, e.g., pulley 8. The cord 5 could be directly exposed to the instep strap 7. Direct exposure of the hook and loop material of instep strap 7 to cord 5 could cause wear of either or both instep strap 7 and/or cord 5.

In the exemplary embodiment, the pulley 8 would be located on a side, e.g., 13*b*, of the shoe upper 6 that opposes the side, e.g., 13*a*, to which the first end 7*a* of the instep strap 7 would be attached.

In the exemplary embodiment, with reference to, e.g., FIGS. 1 and 2, the cord 5 would be inserted through the channels 9 so that the cord 5 would substantially extend around the circumference of the ankle portion 10 of the shoe 1.

In the exemplary embodiment, with reference to FIGS. 1 and 2, in order for a wearer to put on an exemplary embodiment of a shoe of the present invention, the wearer would open the instep strap 7. This would be done by pulling the second end 7*b* of the instep strap 7 to release the hook and loop fastening of the inner layer 7*d* of the second end 7*b* of the instep strap 7 with inner layer 7*d* of the first end 7*a* of the instep strap 7. Once the instep strap 7 is opened, such as is depicted in FIG. 2, the instep strap 7 would slide beneath the pulley 8. It will be understood by someone with ordinary skill in the art, that the hook and loop material of the inner layer 7*d* of the exemplary instep strap 7 could catch on cord 5; the pulley 8 covering cord 5 for the width of the instep strap 7 would provide smooth release and tightening of instep strap 7. However, the pulley 8 is not a limitation of the present invention.

Once the instep strap 7 is opened, such as is depicted in FIG. 2, a wearer could slip the wearer's foot into the shoe 1. Once the wearer's foot is fitted inside the shoe 1, the wearer would then pull the second end 7*b* of the instep strap 7 until the shoe is snugly fit about the wearer's instep and would then fasten the inner layer 7*d* of the second end 7*b* of the instep strap 7 to the inner layer 7*d* of the first end 7*a* of the instep strap 7. By snugly pulling the instep strap 7 upward and across the top of the pulley 8, the instep strap 7 would pull cord end 5*b*, thereby drawing the cord body 5*c* through the various channels 9. Because the opposite end of the cord 5, cord end 5*a*, would be attached to the shoe upper 6, pulling the instep strap 7 upward and across the top of the pulley 8 would, depending on the at-rest tension of the cord, create tension in the cord, increase tension in the cord, and/or slightly distort the cord, thereby snugly cinching the cord 5 around the ankle portion 10 of the shoe 1. The snug cinching of the cord 5 around the ankle portion 10 of the shoe 1 would thereby snugly cinch the ankle portion 10 of the shoe 1 around the wearer's ankle 3*a* (depicted in FIG. 1). An exemplary snugly fit closed shoe 1 is depicted in FIG. 1. Once the instep strap 7 has been snugly pulled, the end 7*b* of instep strap 7 could be fastened to end 7*a* of instep strap 7, thereby securing the snug fit of the cinched cord 5 around the ankle portion 10 of the shoe 1 around the wearer's ankle 3*a* (depicted in FIG. 1).

Figure 5:
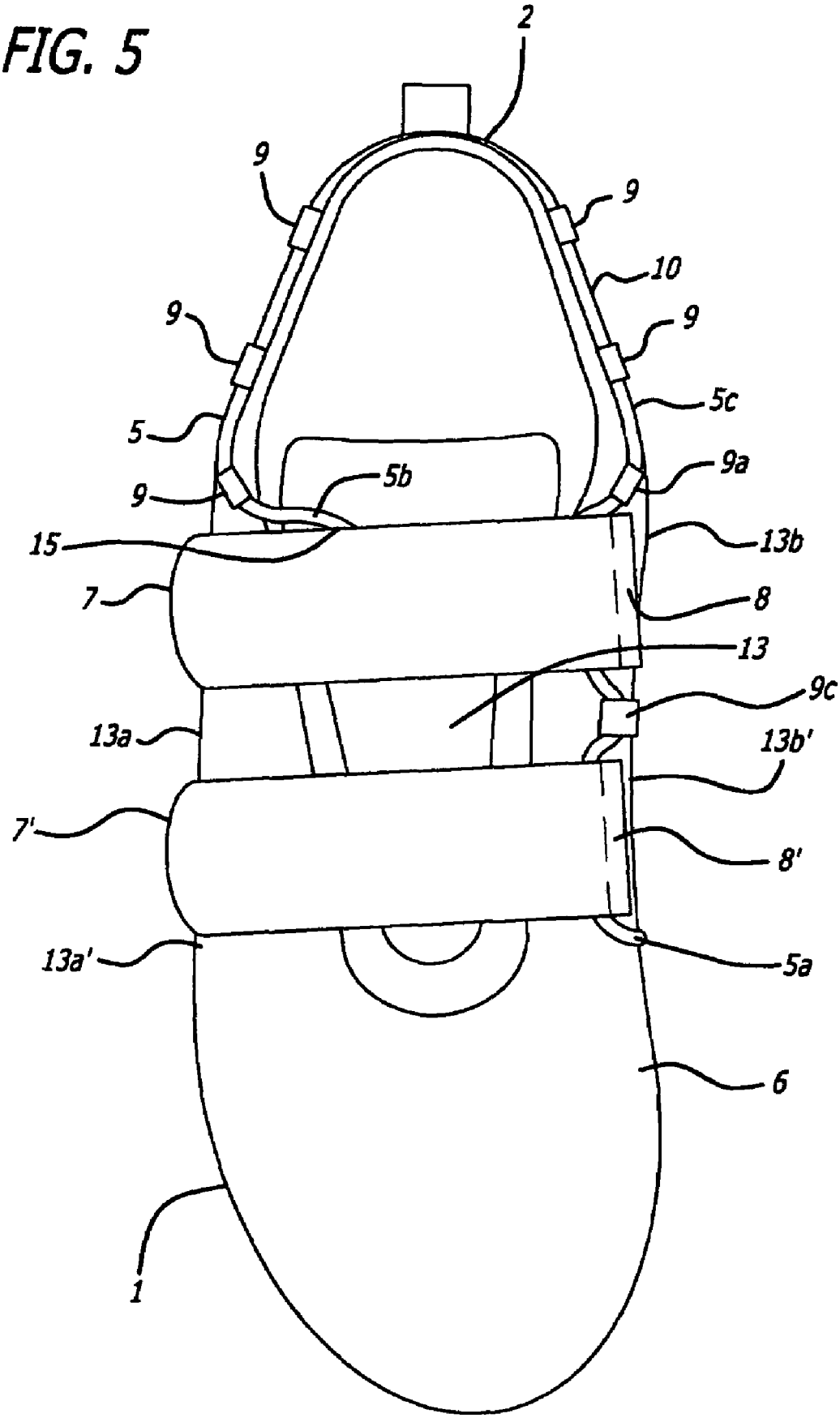
FIG. 5 is a top plan view of an alternative two-instep-strap embodiment of the present invention.

FIG. 5 is a top plan view of an alternative two-instep-strap embodiment of the present invention. In the embodiment depicted in FIG. 5, two instep straps 7 and 7' would be provided. Each instep strap 7 and 7' would wrap around a pulley 8 and 8', respectively. Channels 9*a* and 9*c* would restrict lateral movement of pulley 8 along the length of cord 5. Channel 9*c* and the attachment of the first end 5*a* of cord 5 to the shoe upper 6 would restrict lateral movement of pulley 8' along the length of cord 5. Closure of the two instep straps 7 and 7' would snugly cinch the cord 5 around the ankle portion 10 of the shoe 1. The snug cinching of the cord 5 around the ankle portion 10 of the shoe 1 would thereby snugly cinch the ankle portion 10 of the shoe 1 around a wearer's ankle.

Figure 6:
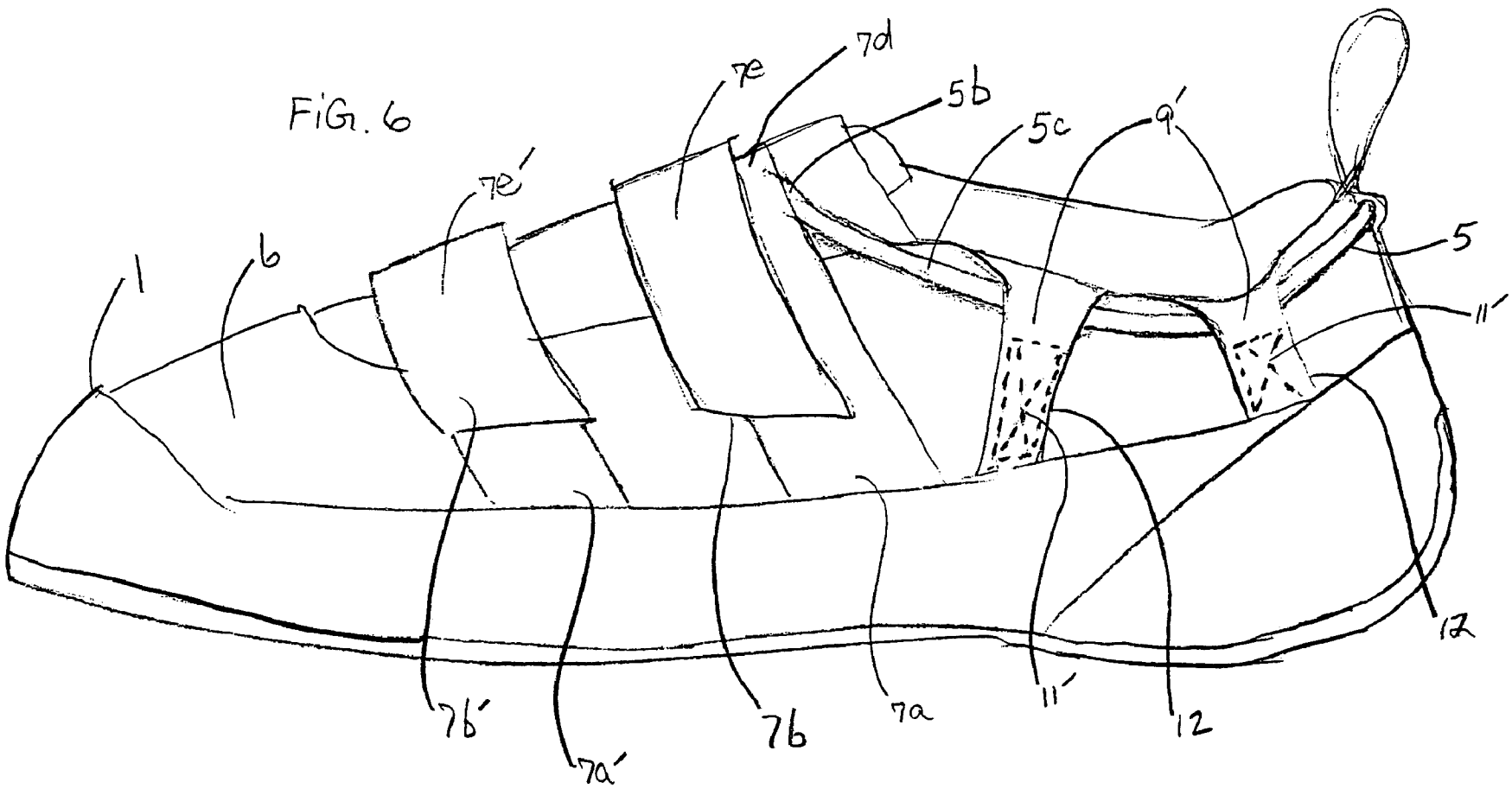
FIG. 6 is a side plan view of a rock climbing shoe embodiment of the present invention.

FIG. 6 is a side plan view of an exemplary rock climbing shoe embodiment of the present invention. In the embodiment depicted in FIG. 6, channels 9' would be formed by cutting the shoe upper 6 with tabs 12 and then fastening the tabs 12, such as with stitching 11', to the shoe upper 6.

It will be understood by someone with ordinary skill in the art that channels, such as channels 9' depicted in FIG. 6, could be formed, fashioned and/or attached to a shoe in various ways. The illustrative ways of forming, fashioning and attaching channels described herein are non-limiting.

Figure 7:
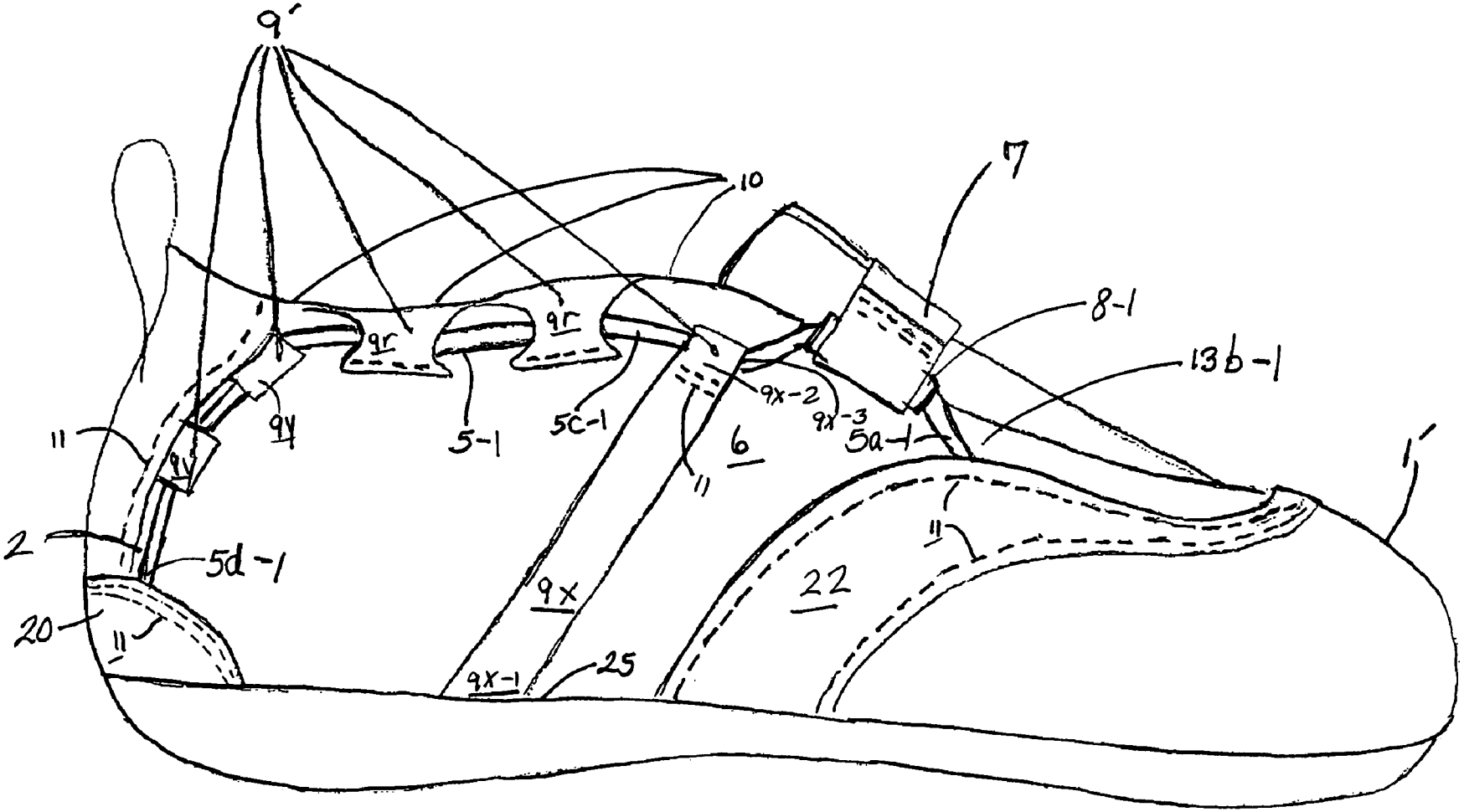
FIG. 7 is a side plan view of a first side of a further alternative exemplary two-cord embodiment of the present invention.
Figure 8:
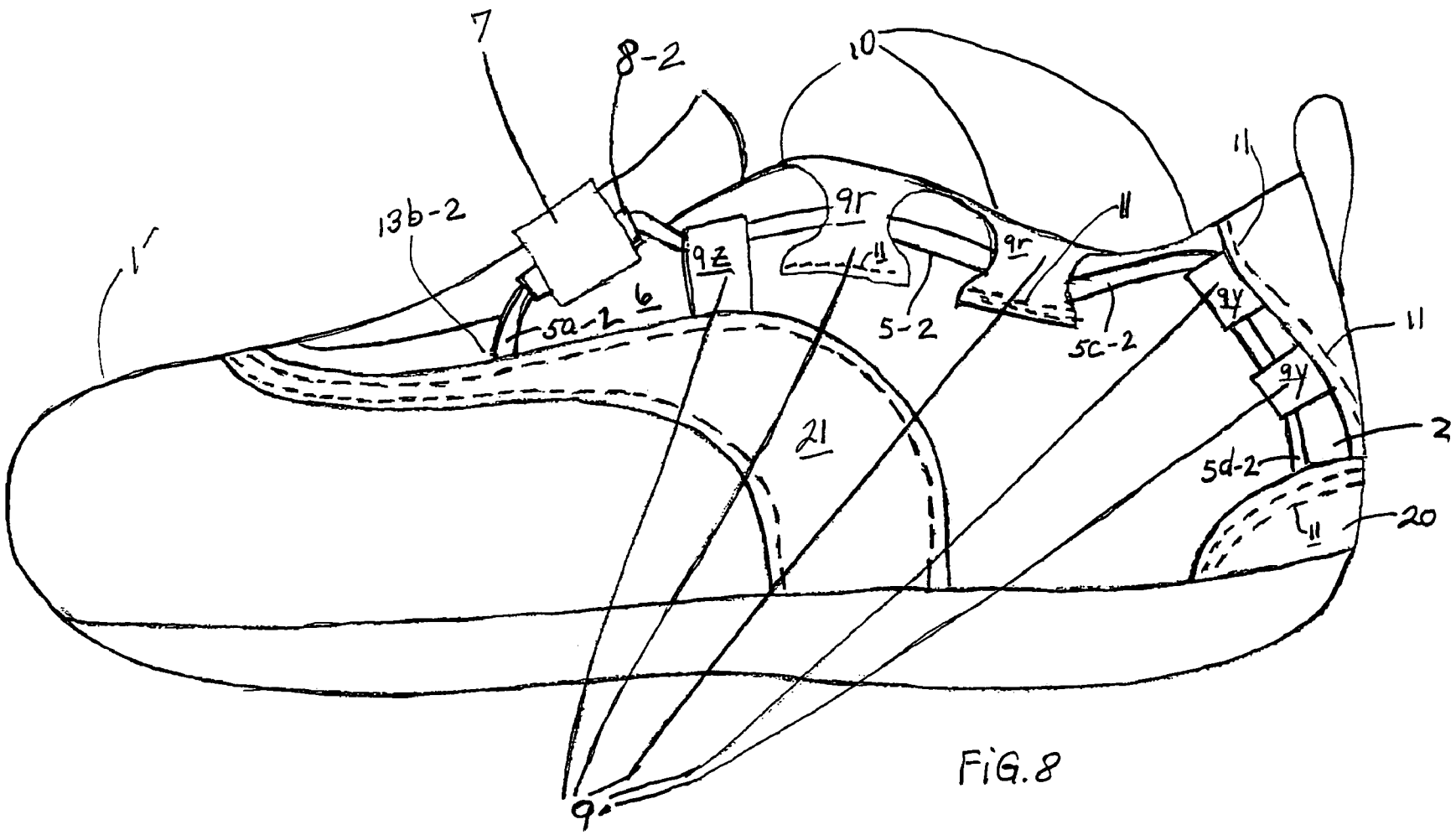
FIG. 8 is a side plan view of a second side of the further alternative exemplary two-cord embodiment of the present invention.
Figure 9:
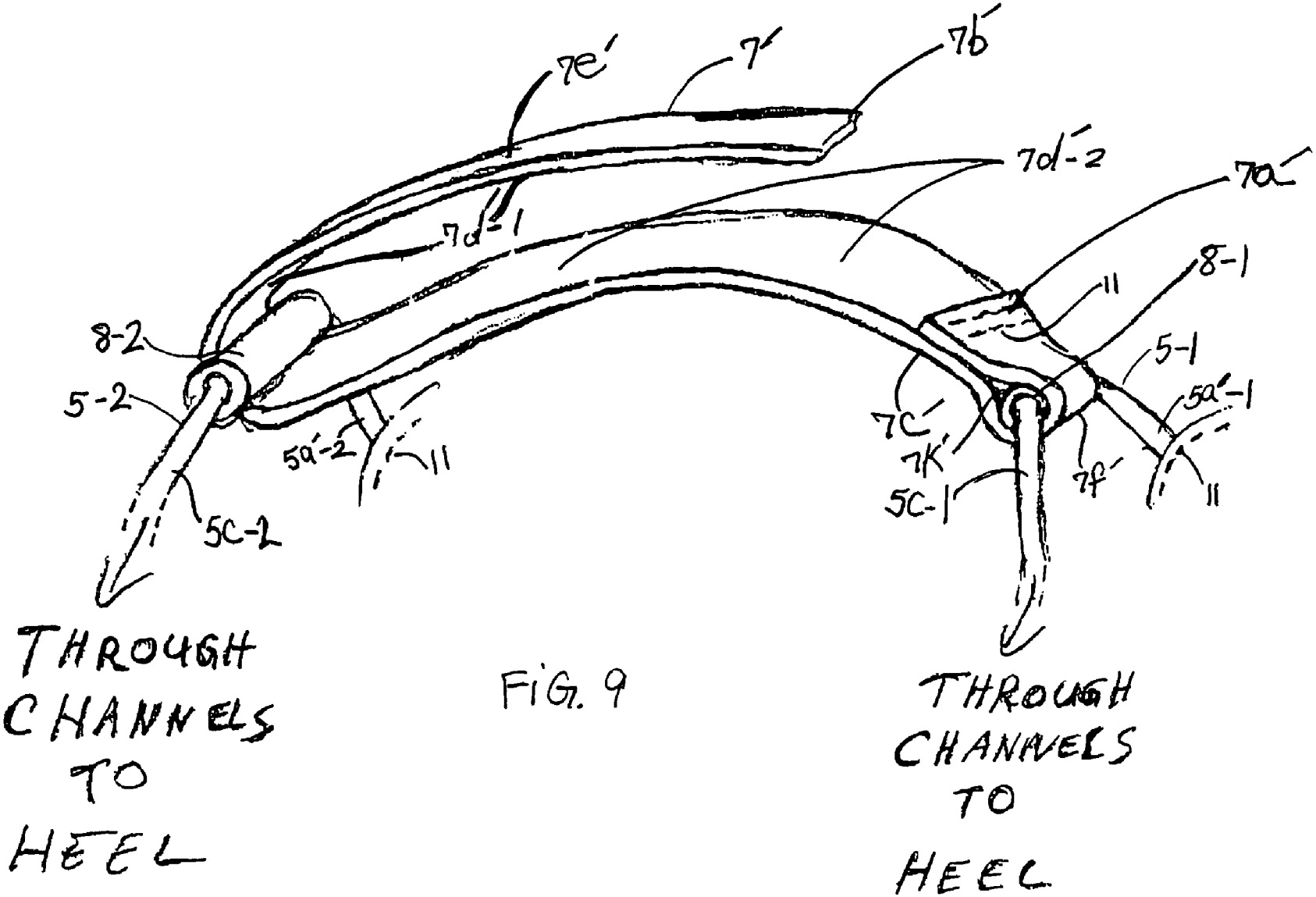
FIG. 9 is an enlarged perspective view of an instep strap in the further alternative exemplary two-cord embodiment of the present invention.

FIG. 7 is a side plan view of a first side of a further alternative exemplary two-cord embodiment of the present invention. FIG. 8 is a side plan view of a second side of the further alternative exemplary two-cord embodiment of the present invention. FIG. 9 is an enlarged perspective view of an instep strap 7' in the further alternative exemplary two-cord embodiment of the present invention.

In the further alternative exemplary two-cord embodiment of the present invention, with reference to FIGS. 7 through 9, the alternative exemplary two-cord ankle cinch would comprise a first cord 5-1 that would comprise a first end 5*a*-1, a second end 5*b*-1, and a body 5*c*-1 between the first and second ends 5*a*-1 and 5*b*-1, respectively. The first end 5*a*-1 of the cord 5-1 would be attached to a first side 13*b*-1 of the shoe upper 6, such as by stitching 11 a first appliqué 22 over the first end 5*a*-1 of the first cord 5-1. It will be understood by someone with ordinary skill in the art that using an appliqué to secure any portion of the cords (5-1 and 5-2) are illustrative and are non-limiting.

In the further alternative exemplary two-cord embodiment of the present invention, with reference to FIGS. 7 through 9, the second end 5*b*-1 of the first cord 5-1 would be attached to the first side 13*b*-1 of the shoe upper 6, at the heel 2, such as by stitching 11 a second appliqué 20 over the second end 5*b*-1 of the first cord 5-1.

In the further alternative exemplary two-cord embodiment of the present invention, with reference to FIGS. 7 through 9, the body 5*c*-1 of the first cord 5-1 would pass through at least one pulley 8-1 and a plurality of channels, or loops, 9'. In the exemplary embodiment, the first cord 5-1 would be comprised of shoelace material, such as nylon cording.

In the further alternative exemplary two-cord embodiment of the present invention, with reference to FIGS. 7 through 9, the alternative exemplary two-cord ankle cinch would comprise a second cord 5-2 that would comprise a first end 5*a*-2, a second end 5*b*-2, and a body 5*c*-2 between the first and second ends 5*a*-2 and 5*b*-2, respectively. The first end 5*a*-2 of the cord 5-2 would be attached to a second side 13*b*-2 of the shoe upper 6, such as by stitching 11 a third appliqué 21 over the first end 5*a*-2 of the second cord 5-2.

In the further alternative exemplary two-cord embodiment of the present invention, with reference to FIGS. 7 through 9, the second end 5*b*-2 of the second cord 5-2 would be attached to the second side 13*b*-2 of the shoe upper 6, at the heel 2, such as by stitching 11 the second appliqué 20 over the second end 5*b*-2 of the second cord 5-2.

In the further alternative exemplary two-cord embodiment of the present invention, with reference to FIGS. 7 through 9, the body 5*c*-2 of the second cord 5-2 would pass through at least one pulley 8-2 and a plurality of channels, or loops, 9'. In the exemplary embodiment, the second cord 5-2 would be comprised of shoelace material, such as nylon cording.

In the further alternative exemplary two-cord embodiment of the present invention, with reference to FIGS. 7 through 9, the channels, or loops, 9 would be attached to the shoe upper (e.g., elements 9*y* and 9*z*) or attached to the sole (e.g., element 9*x*, FIG. 7), such as by stitching 11, or would be integral (e.g., elements 9*r*), to an ankle-level portion 10 of the shoe upper 6.

In the further alternative exemplary two-cord embodiment of the present invention, with reference to FIGS. 7 through 9, the instep strap 7' would comprise a first end 7*a*', a second end 7*b*', and a body 7*c*'. The first end 7*a*' of the instep strap 7' would be attached to the body 7*c*', such as by stitching 11, to form a loop 7*k*' through which pulley 8-1 could be inserted.

In the further alternative exemplary two-cord embodiment of the present invention, with reference to FIGS. 7 through 9, the exemplary instep strap 7' would comprise an outer layer 7*e*'. In the exemplary embodiment, the outer layer 7*e*' would be a leather, or synthetic leather, material. Instep strap 7' would further comprise an inner layer made of a hook and loop material, such as, for example, VELCRO®. Instep strap 7' would comprise a male hook and loop material portion 7*d*'-1 on the second end 7*b*' of instep strap 7' and a female hook and loop material portion 7*d*'-2.

In the further alternative exemplary two-cord embodiment of the present invention, with reference to FIGS. 7 through 9, pulleys 8-1 and 8-2 would each comprise a metallic tube. First cord 5-1 would extend through the pulley 8-1. In the exemplary embodiment, the diameter of the first cord 5-1 would be slightly smaller than the diameter of the interior tube of the pulley 8-1 so that the pulley 8-1 would be adapted for rotation about first cord 5-1. The pulley 8-1 in the exemplary embodiment would have a length that is slightly greater than the width of the loop 7*k*' formed by instep strap 7'. A first channel 9*x* would be attached to the shoe on one side of the pulley 8-1.

In the further alternative exemplary two-cord embodiment of the present invention, with reference to FIGS. 7 through 9, lateral movement of the pulley 8-1 along the length of first cord 5-1 would be bounded on one side by the channel 9*x*, and on the other side by the attachment of the first end 5*a*-1 of first cord 5-1 to the shoe upper 6. The restriction of lateral movement of the pulley 8-1 along the length of first cord 5-1 by the placement of channel 9*x*, and the attachment of the first end 5*a*-1 of first cord 5-1 to the shoe upper 6, would urge the pulley 8-1 to be seated over the midsection 7*f* of the body 7*c*' of the instep strap 7'.

In the further alternative exemplary two-cord embodiment of the present invention, with reference to FIGS. 7 through 9, second cord 5-2 would extend through the pulley 8-2. In the exemplary embodiment, the diameter of second cord 5-2 would be slightly smaller than the diameter of the interior tube of the pulley 8-2 so that the pulley 8-2 would be adapted for rotation about second cord 5-2. Pulley 8-2 in the exemplary embodiment would have a length that is slightly greater than the width of instep strap 7'. A channel 9*z* would be attached to the shoe upper 6 on one side of pulley 8-2 to restrict lateral movement of pulley 8-2 along second cord 5-2 and thereby urge pulley 8-2 to be seated over instep strap 7'.

It will be understood by someone with ordinary skill in the art that benefits of the present invention could be enjoyed without the use of a pulley, e.g., pulleys 8-1 and/or 8-2. The cords 5-1 and/or 5-2 could be directly exposed to the instep strap 7'. Direct exposure of the hook and loop material of instep strap 7' to cords 5-1 and/or 5-2 could cause wear of either or both instep strap 7' and/or the respective cords 5-1 and/or 5-2.

With reference to FIGS. 7 through 9, in order for a wearer to put on a shoe of the further alternative exemplary two-cord embodiment of the present invention, the wearer would open instep strap 7'. This would be done by pulling the second end 7*b*' of the instep strap 7' to release the hook and loop fastening of the inner layer 7*d*'-1 from inner layer 7*d*'-2 of instep strap 7'. Once the instep strap 7' is opened, such as is depicted in FIG. 9, end 7*b*' of instep strap 7' would slide beneath pulley 8-2.

In the further alternative exemplary two-cord embodiment of the present invention, with reference to FIGS. 7 through 9, once the instep strap 7' is opened, such as is depicted in FIG. 9, a wearer could slip the wearer's foot into the shoe 1'. Once the wearer's foot is fitted inside the shoe 1', the wearer would then pull the second end 7*b*' of the instep strap 7' until the shoe is snugly fit about the wearer's instep and would then fasten the inner layer 7*d*'-1 to the inner layer 7*d*'2 of instep strap 7'. By snugly pulling the instep strap 7 upward and across the top of the pulley 8-2, the instep strap 7' would pull both cords 5-1 and 5-2, thereby drawing the cord bodies, 5*c*-1 and 5*c*-2 respectively, through the various respective channels 9. Because one end of the two cords 5-1 and 5-2, cord ends 5*a*-1 and 5*a*-2 respectively, would be attached to the shoe upper 6, and because the opposite ends, 5*d*-1 and 5*d*-2 respectively would be attached to the heel 2 of the shoe 1', pulling the instep strap 7' upward and across the top of the pulley 8-2 would, depending on the at-rest tension in the respective cords, 5-1 and 5-2, create tension and/or increase tension in the respective cords, 5-1 and 5-2, thereby snugly cinching cords 5-1 and 5-2 around the heel 2 and ankle portion 10 of the shoe 1'. Pulling the instep strap 7' would slightly distort the respective cords, 5-1 and 5-2. The snug cinching of the two cords 5-1 and 5-2 around the heel 2 and ankle portion 10 of the shoe 1' would thereby snugly cinch the heel 2 and ankle portion 10 of the shoe 1' around the wearer's heel and ankle (a wearer's ankle is depicted in FIG. 1 as element 3*a*).

Once the instep strap 7' has been snugly pulled, the end 7*b*' of instep strap 7' could be fastened to the hook and loop material 7*d*'-2 of instep strap 7', thereby securing the snug fit of the cinched cords 5-1 and 5-2 respectively around the heel 2 and ankle portion 10 of the shoe 1' around the wearer's foot.

In the further alternative exemplary two-cord embodiment of the present invention, with reference to FIGS. 7 through 9, one end 9*x*-1 of channel 9*x* is fastened to the sole of the shoe, or a bottom portion of the shoe, 25, such as between the shoe upper and the sole of the shoe. The opposite end 9*x*-2 of channel 9*x* is stitched to form a channel loop 9*x*-3 through which a cord, such as cord 5-1, can be inserted. The snug cinching of cord 5-1 would snugly cinch the bottom instep of the shoe 1' to the foot of the wearer.

As will be understood by someone with ordinary skill in the art, other features of the invention are depicted or are implicit in the accompanying figures and above-provided description.

FACSIMILE REPRODUCTION OF COPYRIGHT MATERIAL

A portion of the disclosure of this patent document contains material that is subject to copyright protection by the copyright owner, Charles D. Cole, III, and/or his successors and assigns. The copyright owner has no objection to the facsimile reproduction by anyone of the patent document or the patent disclosure, as it appears in the Patent and Trademark Office patent file or records, but otherwise reserves all copyright rights whatsoever.

TRADEMARKS

VELCRO® is the registered trademark of Velcro Industries. The names of other actual companies and products mentioned herein may be the trademarks of their respective owners.

ILLUSTRATIVE EMBODIMENTS

Although this invention has been described in certain specific embodiments, many additional modifications and variations would be apparent to those skilled in the art. It is, therefore, to be understood that this invention may be practiced otherwise than as specifically described. Thus, the embodiments of the invention described herein should be considered in all respects as illustrative and not restrictive, the scope of the invention to be determined by the appended claims and their equivalents rather than the foregoing description.

What is claimed is:

1. A shoe, said shoe comprising:

a shoe upper having an ankle portion and an instep, said instep comprising an instep top, a first instep side and a second instep side, said first instep side opposite said second instep side;

at least one instep strap, said instep strap comprising a strap body, a first strap end and a second strap end, wherein said first strap end is anchored to the shoe upper at the first side of the instep, said instep strap adapted for crossing over the instep top;

a plurality of channels disposed around a portion of the ankle portion of the shoe upper;

a cord comprising a first cord end, a second cord end, and a cord body, said first cord end connected to the second side of the instep, said cord body disposed through said plurality of channels so that the cord body substantially extends around at least a portion of the ankle portion of the shoe upper, said second cord end disposed through a particular channel of the plurality of channels that is disposed in proximity to the first side of the instep;

wherein the second strap end is adapted for passing under a portion of the cord body in proximity to the second side of the instep, disposing a portion of the strap body for engagement with the portion of the cord body for cinching the cord body around at least a portion of the ankle portion, and disposing a portion of the strap body for attachment in proximity to the first strap end.

2. The shoe of claim 1 wherein a pulley is disposed on the cord and wherein the instep strap passes under the pulley.

3. The shoe of claim 1, wherein the strap body comprises a strap body layer that comprises a hook and loop material, and wherein the second strap end is adapted for passing under a portion of the cord body in proximity to the second side of the instep so that the strap body layer in proximity to the second strap end is disposed for attachment to the strap body layer in proximity to the first strap end.

4. The shoe of claim 1, wherein said second cord end is connected to the instep strap.

5. The shoe of claim 4, wherein the strap body comprises a strap body layer that comprises a hook and loop material, and wherein the second strap end is adapted for passing under a portion of the cord body in proximity to the second side of the instep so that the strap body layer in proximity to the second strap end is disposed for attachment to the strap body layer in proximity to the first strap end.

6. A method of snugly cinching a shoe, said method comprising:

attaching a first end of a first cord to a first side of an instep of a shoe, wherein the first end of the first cord is attached to a first instep portion of the first side of a shoe upper of the shoe;

threading a second end of the first cord through at least one channel, wherein said at least one channel is disposed around a circumference of the ankle portion of the shoe; and attaching the second end of the first cord to a heel portion of the first side of the shoe upper of the shoe.

7. The method of claim 6, said method further comprising:

attaching a first end of a second cord to an instep portion of a second side of a shoe upper of the shoe; and attaching a second end of the second cord, to a heel portion of the second side of the shoe upper of the shoe.

8. The method of claim 7, said method further comprising:

enclosing a portion of the second cord with a first end of a strap, wherein a second end of the strap is adapted for threading under a portion of the first cord.

9. A shoe, said shoe comprising:

at least one channel disposed around a circumference of an ankle portion of the shoe, wherein the channel is adapted for receiving a cord inserted therethrough; and a first cord, said first cord comprising a first end and a second end, wherein said first end of said first cord is attached to a first side of the shoe, and wherein said first cord is disposed through the at least one channel, wherein said first end of said first cord is attached to an instep portion of a first side of a shoe upper of the shoe, and wherein the second end of the first cord is attached to a heel portion of the first side of the shoe upper of the shoe.

10. The shoe of claim 9, said shoe further comprising:

a plurality of channels disposed around the circumference of the ankle portion of the shoe, wherein each channel of the plurality of channels is adapted for receiving a cord inserted therethrough.

11. The shoe of claim 10, wherein said first end of said first cord is attached to a first instep portion of a first side of a shoe upper of the shoe, wherein the second end of the first cord is attached to second instep portion of a second side of the shoe upper of the shoe, and wherein the cord is disposed through the plurality of channels.

12. The shoe of claim 9, said shoe further comprising:

a second cord, said second cord comprising a first end and a second end, wherein said first end of said second cord is attached to an instep portion of a second side of a shoe upper of the shoe, and wherein the second end of the second cord is attached to a heel portion of the second side of the shoe upper of the shoe.

13. The shoe of claim 12, said shoe further comprising:

an instep strap, said instep strap comprising a first end and a second end, wherein the first end of the instep strap is disposed to form a loop, said loop disposed to receive a portion of the second cord, and wherein the second end of the instep strap is adapted for threading under a portion of the first cord.

* * * * *